US005402653A

United States Patent [19]

Yanadori

[11] Patent Number: 5,402,653

[45] Date of Patent: Apr. 4, 1995

[54] REFRIGERATING APPARATUS PROVIDED WITH CHEMICAL TYPE REFRIGERATING UNIT AND COMPRESSION TYPE HEAT PUMP

[75] Inventor: Michio Yanadori, Ryugasaki, Japan

[73] Assignee: Hitachi, Ltd., Tokyo, Japan

[21] Appl. No.: 205,634

[22] Filed: Mar. 4, 1994

[30] Foreign Application Priority Data

Mar. 18, 1993 [JP] Japan ..... 5-058404

[51] Int. Cl.[6] ..... F25B 25/00

[52] U.S. Cl. ..... 62/333; 62/335

[58] Field of Search ..... 62/333, 335

[56] References Cited

U.S. PATENT DOCUMENTS

| | | | |
|---|---|---|---|
| 4,288,993 | 9/1981 | van Mensvoort et al. | 62/333 |
| 4,439,994 | 4/1984 | Briley | 62/335 X |
| 4,869,069 | 9/1989 | Scherer | 62/335 X |
| 4,936,109 | 6/1990 | Longardner | 62/335 X |
| 5,018,367 | 5/1991 | Yamada et al. | 62/335 X |

FOREIGN PATENT DOCUMENTS

| | | |
|---|---|---|
| 61-11574 | 1/1986 | Japan . |
| 61-125561 | 6/1986 | Japan . |
| 3-7859 | 1/1991 | Japan . |

*Primary Examiner*—William E. Tapolcai

*Attorney, Agent, or Firm*—Antonelli, Terry, Stout & Kraus

[57] ABSTRACT

A refrigerating apparatus according to the present invention is composed of the combination of a chemical type refrigerating unit and a compression type heat pump. The chemical type compression unit includes reactors each having a reaction material accommodated therein and the reactors are provided with heat exchangers of the compression type heat pump. Further, heat exchangers of the compression type heat pump are provided with the condenser of the chemical type refrigerating unit. Heat of condensation produced in the condenser is recovered by the heat exchangers of the compression type heat pump and the heat exchangers of the reactors are selectively switched so that they are heated or cooled by the compression type heat pump.

11 Claims, 7 Drawing Sheets

REFRIGERATING APPARATUS PROVIDED WITH CHEMICAL TYPE REFRIGERATING UNIT AND COMPRESSION TYPE HEAT PUMP

BACKGROUND OF THE INVENTION

1. FIELD OF THE INVENTION

The present invention relates to a refrigerating apparatus composed of the combination of a chemical type refrigerating unit and a compression type heat pump.

2. DESCRIPTION OF THE PRIOR ART

There are known examples near to the present invention which are disclosed in Japanese Patent Unexamined Publication No. 3-7859, Japanese Patent Unexamined Publication No. 61-125561 and Japanese Patent Unexamined Publication No. 61-11574. These apparatuses disclose that an refrigerating output can be obtained by repeating an absorption process and a desorption process.

SUMMARY OF THE INVENTION

The refrigerating apparatuses disclosed in the above prior art, however, have a problem in that they cannot sufficiently recover sensible heat after the reaction materials in reactors have been refreshed as well as the heat of condensation of steam in a condenser also cannot be sufficiently recovered, and thus they cannot obtain a large heat efficiency.

A first object of the present invention is to provide a refrigerating apparatus which is suitable for the operation of various kinds of refrigerating units and by which the sensible heat and heat of condensation can be efficiently recovered.

A second object of the present invention is to provide a refrigerating apparatus capable of jointly using heat obtained from the outside.

According to an aspect of the preset invention, there is provided a refrigerating apparatus, which comprises a chemical type refrigerating unit including a first reactor having a reaction material accommodated therein, a second reactor having a reaction material accommodated therein, a condenser capable of communicating with the first reactor and the second reactor, first valve units for selectively communicating any one of the first reactor and the second reactor with the condenser, an evaporator for accommodating a liquid condensed by the condenser through a pipe and evaporating the liquid, and second valve units for selectively communicating any one of the first reactor and the second reactor with the evaporator; and a compression type heat pump including a compressor, a first heat exchanger provided with the first reactor, a second heat exchanger provided with the second reactor, a third heat exchanger and a fourth heat exchanger each provided with the condenser, a pressure reduction mechanism, and flow path switching units which are selectively switched to form a first circulating path for introducing a compressed medium output from the compressor to the second heat exchanger to heat the reaction material in the second reactor and introducing a pressure reduced medium having passed through the pressure reduction mechanism to the first heat exchanger to cool the reaction material in the first reactor and introducing the pressure reduced medium to the third heat exchanger to cool the condenser and a second circulating path for introducing a compressed medium output from the compressor to the first heat exchanger to heat the reaction material in the first reactor and introducing the pressure reduced medium having passed through the pressure reduction mechanism to the second heat exchanger to cool the reaction material in the second reactor and introducing the pressure reduced medium to the fourth heat exchanger to cool the condenser.

According to another aspect of the present invention, there is provided a refrigerating apparatus, which comprises a chemical type refrigerating unit including not less than three sets of reactors each having a reaction material accommodated therein, a condenser capable of communicating with each of the reactors, an evaporator for accommodating a liquid condensed by the condenser through a pipe and evaporating the liquid, and valve units for communicating any of the reactors with the condenser and communicating the other of the reactors with the evaporator; and a compression type heat pump including a compressor, heating heat exchangers and cooling heat exchangers provided with the respective reactors, a cooling heat exchanger provided with the condenser, a pressure reduction mechanism, and switching units for forming a medium circulation path so that any of the heating heat exchangers provided with any of the reactors heats the reaction material in the reactor and the cooling heat exchangers of the remaining ones of the reactors cool the reaction materials in the remaining ones of the reactors as well as the cooling heat exchanger provided with the condenser cools the condenser.

According to a further aspect of the present invention, there is provided a refrigerating apparatus, which comprises a chemical type refrigerating unit including a reactor having a reaction material accommodated therein, a condenser capable of communicating with the reactor, a first valve unit for selectively communicating the reactor with the condenser, an evaporator for accommodating a liquid condensed by the condenser through a pipe and evaporating the liquid, and a second valve unit for selectively communicating the evaporator with the reactor; and compression type heat pump including a compressor, a heat exchanger provided with the reactor, a heat exchanger provided with the condenser, a pressure reduction mechanism, and flow path switching units which are selectively switched to form a first circulation path for introducing a compressed medium output from the compressor to the heat exchanger provided with the reactor and introducing a pressure reduced medium having passed through the pressure reduction mechanism to the heat exchanger provided with the condenser and a second circulation path for introducing the pressure reduced medium having passed through the pressure reduction mechanism to the heat exchanger provided with the reactor and returning the medium having passed through the heat exchanger to the compressor.

According to the present invention, the combination of the chemical type refrigerating unit and the compression type heat pump enables the heat of condensation discharged from the condenser of the chemical type refrigerating apparatus and the heat held by the reaction materials in the reactors after the reaction materials have been refreshed to be efficiently recovered and effectively used, and thus the efficiency of the refrigerating apparatus of the present invention can be improved.

DESCRIPTION OF PREFERRED EMBODIMENTS

Figure 1:
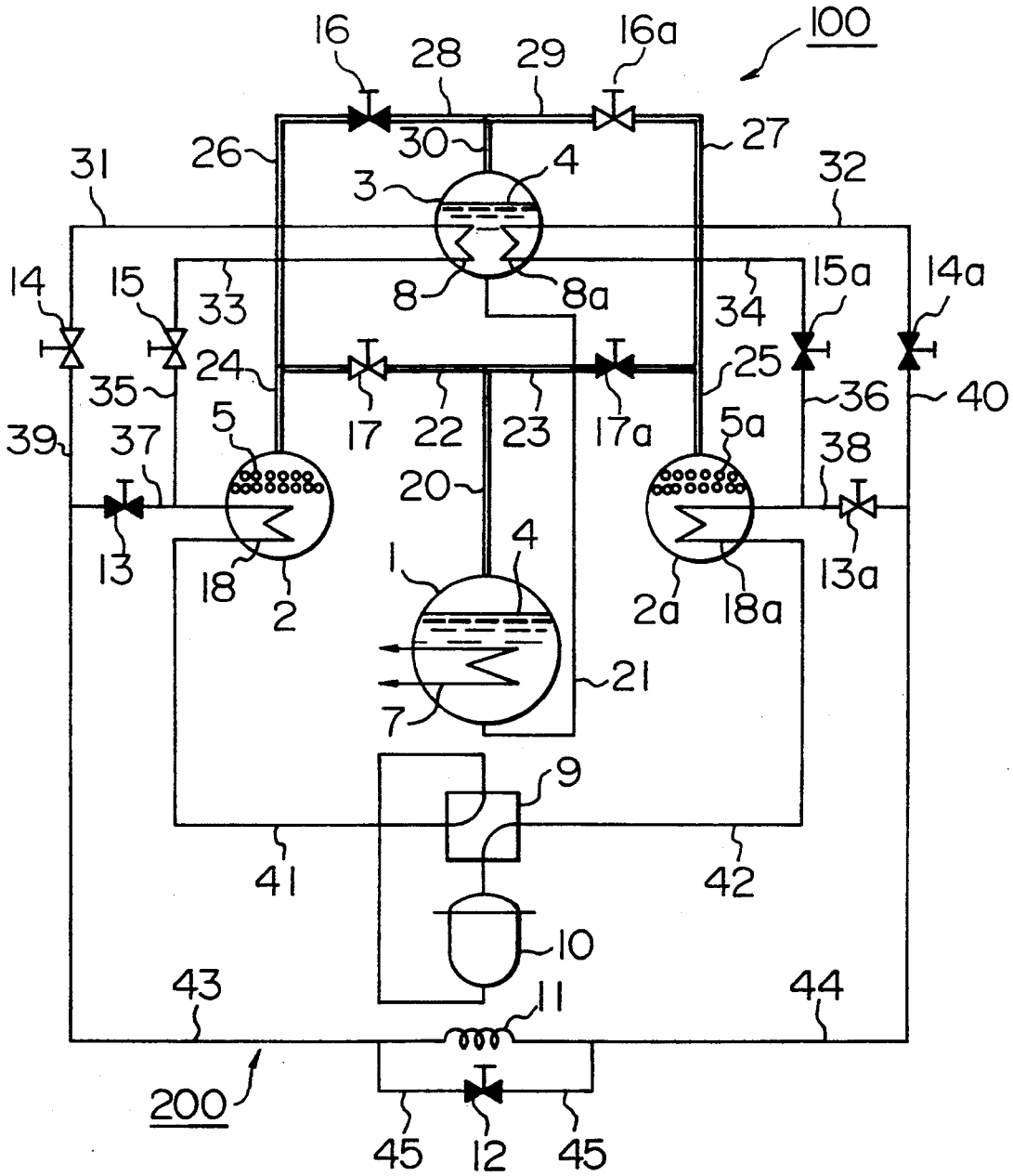
FIG. 1 is a block diagram of an embodiment of a refrigerating apparatus of the present invention.

An embodiment of the present invention will be described with reference to FIG. 1 through FIG. 4. FIG. 1 is a block diagram of a refrigerating apparatus of this embodiment.

The refrigerating apparatus of the present invention is composed of the combination of a chemical type refrigerating unit 100 and a compression type heat pump 200. The chemical type refrigerating unit 100 is mainly composed of a first reactor 2, a second reactor 2*a*, an evaporator 1, a condenser 3 and pipes 24, 22, 20, 23, 25, 26, 28, 29, 27, 30 and 21 through which the above components are interconnected as shown by double lines in FIG. 1. Further, the compression type heat pump 200 is mainly composed of a compressor 10, a 4-way valve 9, heat exchangers 8, 8*a*, 18 and 18*a*, a pressure reduction mechanism 11, and pipes 31$^{TM}$, 32, 33, 34, 37, 38, 41, 42, 43, 44, 45 and valves 14, 15, 14*a*, 15*a*, 13, 13*a*, 12 and the like by which the above components are interconnected to form a circulating path.

FIG. 1 shows a state in which the first reactor 2 and evaporator 1 of the chemical type refrigerating unit 100 are in a refrigerating operation and the second reactor 2*a* and condenser 3 thereof are in a refreshing operation. In FIG. 1, black valves show a closed state and white valves show an open state. Thus, the valve 17 in the pipe 22 is opened, the valve 17*a* in the pipe 23 is closed, the valve 16 in the pipe 28 is closed and the valve 16*a* in the pipe 29 is opened.

The first reactor 2 and second reactor 2*a* contain silica gel, zeolite, a water solution of lithium bromide or the like as reaction materials 5, 5*a* and the evaporator 1 contains water, ethanol, methanol or the like as a liquid 4. A heat medium (flon or steam) compressed and heated by the compressor 10 of the compression type heat pump 200 flows into the heat exchanger 18*a* through the 4-way valve 9 and pipe 42 and liquefied therein while discharging heat of condensation. The heat of condensation is transferred to the reaction material 5*a* through the external surface of the heat exchanger 18*a*. The liquid 4 contained in the reaction material 5*a* is gradually desorbed and made to steam, enters the condenser 3 through the pipes 25, 27, valve 16*a* and pipe 30 and cooled therein to discharge heat of condensation and liquefied. The condensed liquid 4 enters the evaporator 1 through the pipe 21. On the other hand, since the evaporator 1 and first reactor 2 are in the refrigerating operation, the temperature of the liquid 4 in the evaporator 1 is reduced by the evaporating action thereof. Consequently, the temperature of the liquid 4 which enters the evaporator 1 through the pipe 21 is also gradually reduced.

On the other hand, the heat medium which flows into the heat exchanger 18*a* of the compression type heat pump 200 is adiabatically expanded while it passes through the pressure reduction mechanism 11 (expansion valve or capillary tube) through the pipe 44 and further enters the heat exchanger 8 provided with the condenser 3 through the pipe 43, a pipe 39, the valve 14 and the pipe 31, where the heat medium is evaporated by receiving the heat of condensation discharged in the condenser 3 and further enters the heat exchanger 18 provided with the first reactor 2 through the pipe 33, the valve 15 and a pipe 35, receives the heat produced by the reaction material 5 through the outer surface of the heat exchanger 18 and is returned to the compressor 10 through the pipe 41 and 4-way valve 9. In this process, the heat produced in the condenser 3 and first reactor 2 is efficiently recovered by the compression type heat pump 200, transferred to the second reactor 2*a* and used to refresh the reaction material 5*a*.

When the reaction material 5*a* in the second reactor 2*a* has been refreshed, all the valves disposed in the chemical type refrigerating unit 100 are temporarily closed. Further, the valves 14, 15 used to the compression type heat pump are closed, whereas the valves 13 and 12 are opened. When the valve 12 in the pipe 45 provided in parallel with the pressure reduction mechanism 11 is opened, the heat medium does not flow through the pressure reduction mechanism 11 and thus a cooling action is not performed by adiabatic expansion. Consequently, the heat exchanges 18 and 18*a* have the same temperature due to the evaporating action and condensing action of the heat medium contained therein. As a result, the heat of the reaction material 5*a* in the second reactor 2*a* is recovered and transferred to the reaction material 5 in the first reactor 2. In this balance operation, the compressor 10 may be stopped. On the completion of the balance operation, the valve 12 is closed again, the valves 13, 14*a*, 15*a* are opened, the valve 13*a* is closed and the 4-way valve 9 is switched to drive the compressor 10. Further, the valves 16, 17 of the chemical type refrigerating unit 100 are opened.

Figure 2:
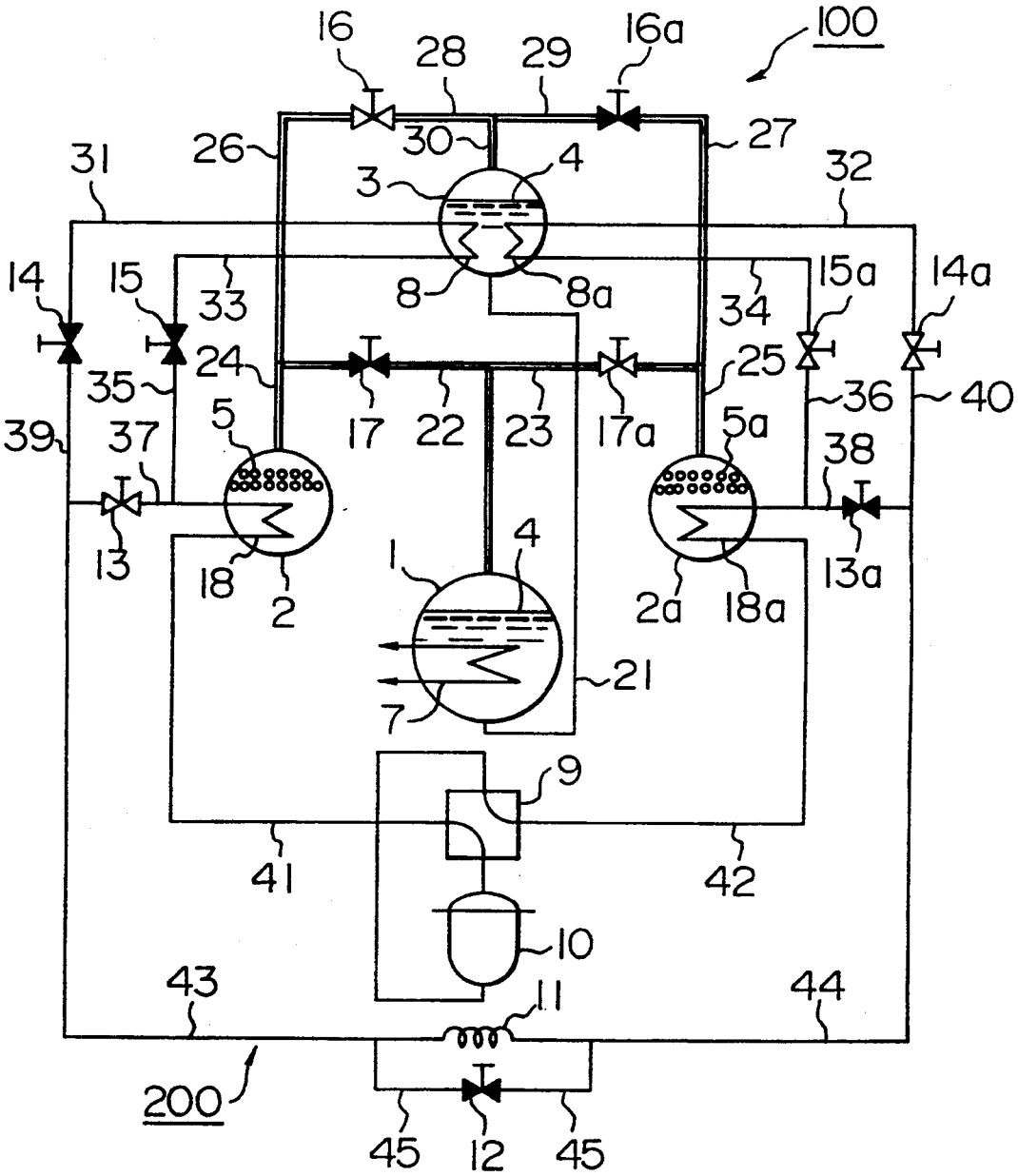
FIG. 2 is a block diagram showing a state in which the operating state of the refrigerating apparatus shown in FIG. 1 is changed.

As shown in FIG. 2, since the system is operated in the cycle completely reverse to that shown in FIG. 1, the heat exchanger 18 acts as a condenser and the heat exchangers 18*a*, 8*a* act as evaporators. Consequently, the heat held by the reaction material 5*a* and the heat held by the liquid 4 in the condenser 3 are recovered and effectively used to refresh the reaction material 5 in the first reactor 2. With the above operation, the cooling action of the liquid 4 in the evaporator 1 is continued so that cold heat can be taken out through the heat exchanger 7 provided with the evaporator 1 and used for refrigeration, air conditioning and the like.

In this embodiment, the heat exchangers 8, 8*a* provided with the condenser 3 may be commonly used by being integrally arranged through fins. Further, branch circuits may be provided between the pipes 41, 43 and between the pipes 42, 44 of the compression type heat pump 200, respectively and heat exchangers may be connected to the branch circuits so that the heat of air, well water and the like is supplied and used together with the heat of condensation produced in the condenser 3 and the heat of reaction produced in the reactors 2, 2*a* to refresh the reaction material 5 or 5*a*.

Figure 3:
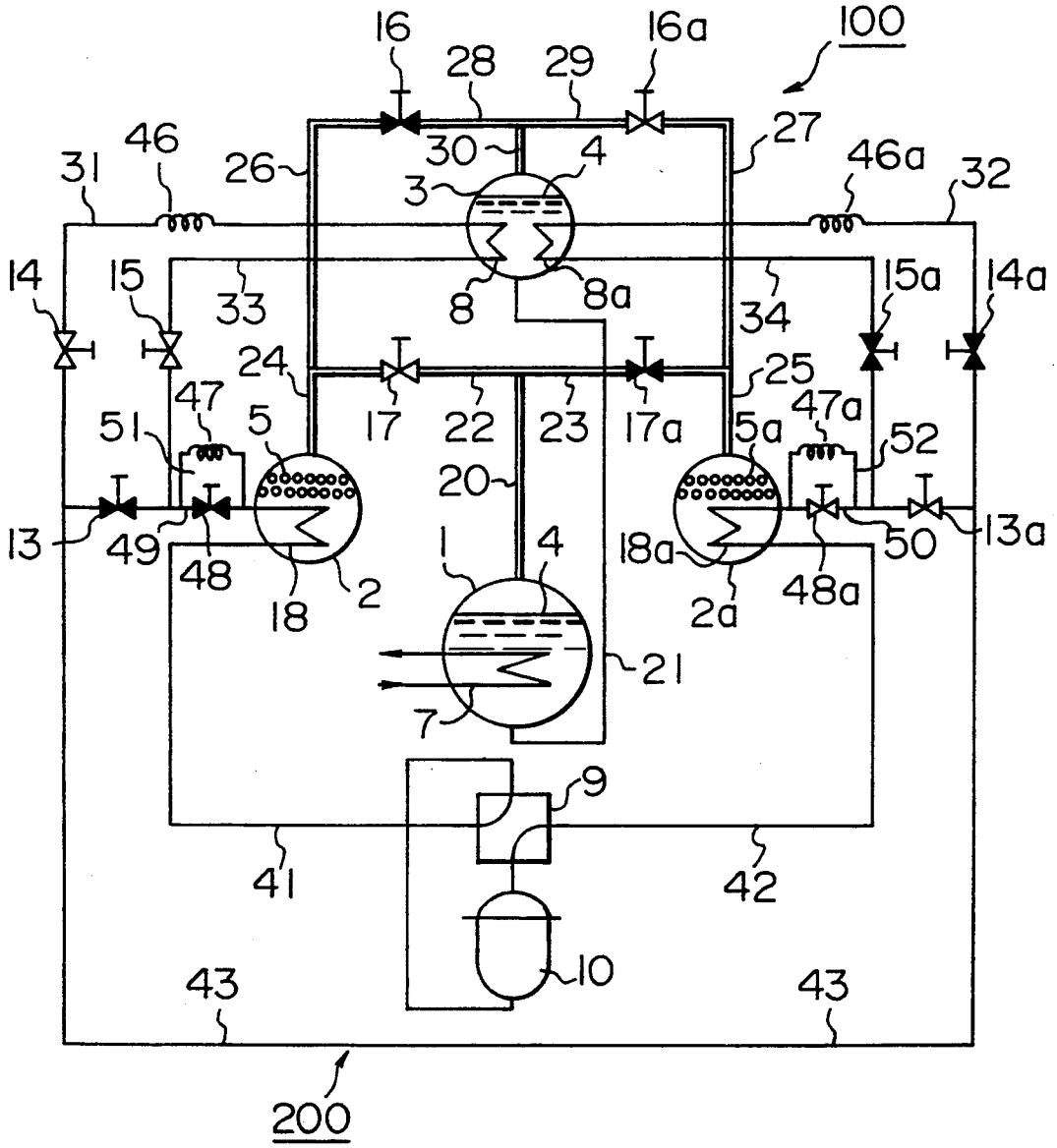
FIG. 3 is a block diagram of a modified example of the refrigerating apparatus shown in FIG. 1.

FIG. 3 is a block diagram of a refrigerating apparatus showing a modified example of this embodiment. Although the embodiment shown in FIG. 3 has the same arrangement as that shown in FIG. 1, a refrigerating operation is carried out between an evaporator 1 and a first reactor 2 and a refreshing operation is carried out between a second reactor 2*a* and a condenser 3 in a chemical type refrigerating unit 100 shown in FIG. 3.

Although the heat exchanger 8 is connected to the heat exchanger 18 in series and the heat exchanger 8*a* is connected to the heat exchanger 18*a* also in series and the single pressure reduction mechanism is provided in the embodiment shown in FIGS. 1 and 2, in this embodiment a pressure reduction mechanism is provided with each heat exchanger in front of a position where a heat medium enters the heat exchanger so that a cooling ratio corresponding to the performance of each heat exchanger can be obtained. More specifically, a pressure reduction mechanism 46 is provided with a pipe 31 connected to a heat exchanger 8 and a pressure reduction mechanism 46*a* is provided with a pipe 32 connected to a heat exchanger 8*a*. Further, a pressure reduction mechanism 47 is provided with a pipe 51 connected to a heat exchanger 18 and a pipe 49 from which the pipe 51 is branched is provided with a valve 48. Further, a pressure reduction mechanism 47*a* is provided with a pipe 52 connected to a heat exchanger 18*a* and a pipe 50 from which the pipe 52 is branched is provided with a valve 48*a*.

In this embodiment, the valve 48*a* and valves 13*a*, 14 and 15 are opened and a valve 13, the valve 48 and valves 14*a*, 15*a* are closed, and thus the heat exchangers 8, 18 are in a cooled state and the heat exchanger 18*a* is in a heated state. As a result, the heat of condensation in the condenser 3 and the heat of reaction in the first reactor 2 are recovered and effectively used to refresh the second reactor 2*a*.

Figure 4:
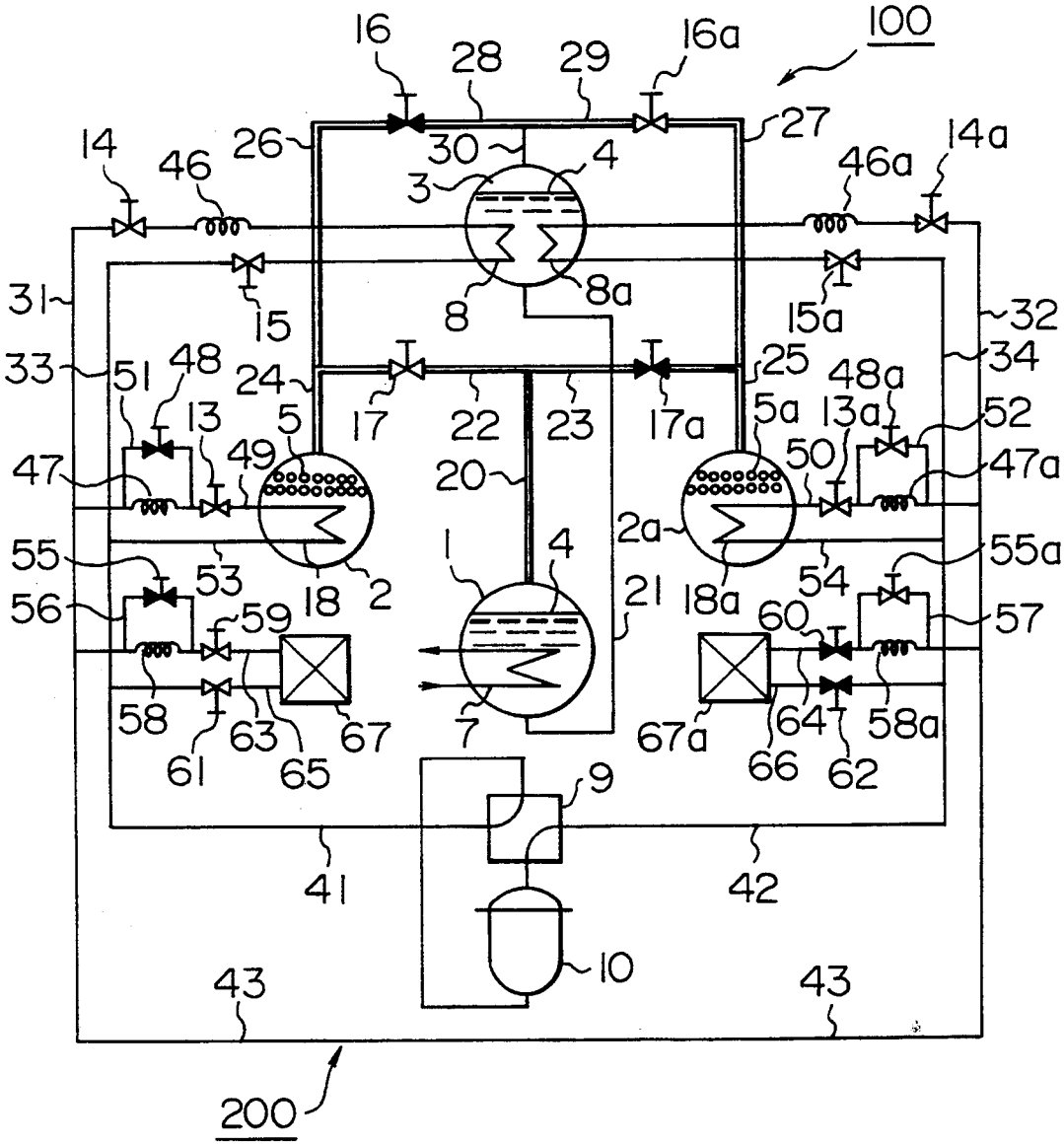
FIG. 4 is a block diagram of a modified example of the refrigerating apparatus shown in FIG. 3.

FIG. 4 is a block diagram of a refrigerating apparatus showing a modified example of this embodiment. Although the embodiment shown in FIG. 4 has the same arrangement as that shown in FIG. 3, in this embodiment heat exchangers 8, 18, 67 are connected to pipes 41, 43 in parallel and heat exchangers 8*a*, 18*a*, 67*a* are connected to the pipes 42, 43 also in parallel and pressure reduction mechanisms 46, 47, 58, 46*a*, 47*a*, 58*a* are provided with the respective pipes connected to these heat exchangers. In this embodiment, valves 14, 15 are opened, the valve 13 provided with a pipe 49 is opened, the valve 48 of the pipe 51 branched from the pipe 49 is closed, the valves 59, 61 provided with pipes 63, 65, respectively are opened, the valve 55 of the pipe 56 branched from the pipe 63 is closed, and the heat exchangers 8, 18 are in the cooled state. On the other hand, valves 14*a*, 15*a* are closed, the valve 13*a* attached to a pipe 50 is opened, the valve 48*a* of the pipe 52 branched from the pipe 50 is opened, the valves 60, 62 provided with pipes 64, 66, respectively are closed, the valve 55*a* of the pipe 57 branched from the pipe 64 is opened, and thus the heat exchanger 18*a* is heated.

With the arrangement as described above, the heat of condensation in the condenser 3, the heat held by the reaction material 5 in the first reactor 2 and the heat obtained by the heat exchanger 67 from the outside are effectively used to refresh the reaction material 5*a* of the second reactor 2*a*. Note, the heat exchangers 67 and 67*a* can be commonly used as an integral unit.

Figure 5:
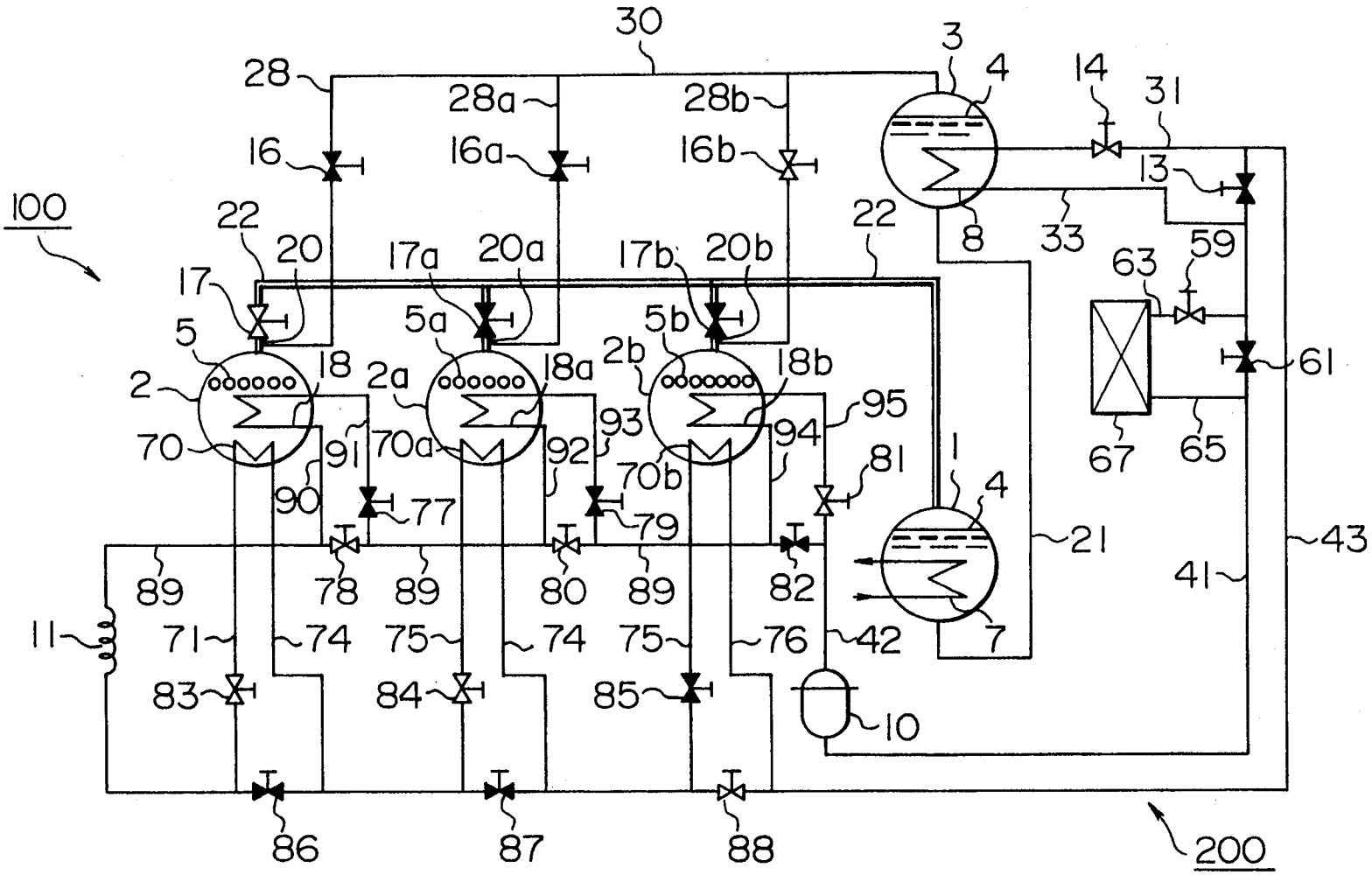
FIG. 5 is a block diagram of another embodiment of the refrigerating apparatus of the present invention.

A further embodiment of the present invention will be described with reference to FIGS. 5 and 6. FIG. 5 is a block diagram showing a refrigerating apparatus of this embodiment.

As shown in FIG. 5, the refrigerating apparatus of this embodiment includes three sets of reactors, and thus the refreshing and cooling of reaction materials and the evaporation of a liquid in an evaporator can be continuously carried out. A chemical type refrigerating unit 100 is mainly composed of a first reactor 2, a second reactor 2*a*, a third reactor 2*b*, an evaporator 1 and a condenser 3 and these components are interconnected through pipes 20, 20*a*, 20*b*, 22, 21, 30, 28, 28*a*, 28*b* and valves 17, 17*a*, 17*b*, 16, 16*a*, 16*b* and the like as shown in FIG. 5. Further, a compression type heat pump 200 is mainly composed of a compressor 10, heat exchangers 8, 67, heating heat exchangers 18, 18*a*, 18*b*, cooling heat exchangers 70, 70*a*, 70*b*, and a pressure reduction mechanism 11, and these components are interconnected through pipes and the like as shown in FIG. 5.

In this embodiment, since the valve 17 is opened and the valves 17*a*, 17*b* are closed, the first reactor 2 is communicated with the evaporator 1 through the pipe 22 so that a liquid 4 in the evaporator 1 is cooled by a reaction material 5. On the other hand, since the valves 16, 16*a* are closed and the valve 16*b* is opened, the third reactor 2*b* is communicated with the condenser 3 through the pipes 28*b*, 30 so that a reaction material 5*b* is in a refreshed state. Consequently, the first reactor 2 must be cooled and the third reactor 2*b* must be heated. Further, the reaction material 5*a* in the second reactor 2*a* has been refreshed and still has a high temperature, and thus the reaction material 5*a* must be cooled. Consequently, a heat medium of high temperature must be flown through the heating heat exchanger 18*b* of the compression type heat pump 100, and thus a valve 81 is opened and a valve 82 is closed. On the other hand, since valves 77, 79 are closed and valves 78, 80 are opened, the heat medium of high temperature is not flown into the heating heat exchangers 18, 18*a*. Further, a heat medium of low temperature must be flown into the cooling heat exchangers 70, 70*a*, and thus valves 83, 84 are opened and valves 86, 87 are closed. On the other hand, the heat medium of low temperature is not flown into the cooling heat exchanger 70*b* by closing a valve 85 and opening a valve 88. Further, since a valve 14 is opened, the heat medium of low temperature is flown into the heat exchanger 8 and the heat thereof is recovered and effectively used to refresh the reaction material 5*b* while cooling the liquid 4 in the condenser 3 by the heat. Further, a valve 59 is opened to flow the heat medium of low temperature to the heat exchanger 67 to obtain heat from the outside and this heat is also effectively used to refresh the reaction material 5*b*. Valves 13, 61 are used to select the utilization of the heat obtained from the heat exchangers 8, 67. The reactor 2*a* can be switched to a heat discharge process, the reactor 2*b* can be switched to a cooling process and the reactor 2 can be switched to a refresh process by the same method as that described above and the liquid 4 in the evaporator 1 can be continuously cooled by this method. Note, in this embodiment, the heat exchangers 18, 70, 18*a*, 70*a*, 18*b*, 70*b* in the reactors 2, 2*a*, 2*b* may include fins attached to the outside thereof to improve a heat transfer property, and in this case the fins of the heat exchangers 18 and 70, the fins of the heat exchangers 18*a* and 70*a* and the fins of the heat exchangers 18*b* and 70*b* may be integrally formed and commonly used.

Figure 6:
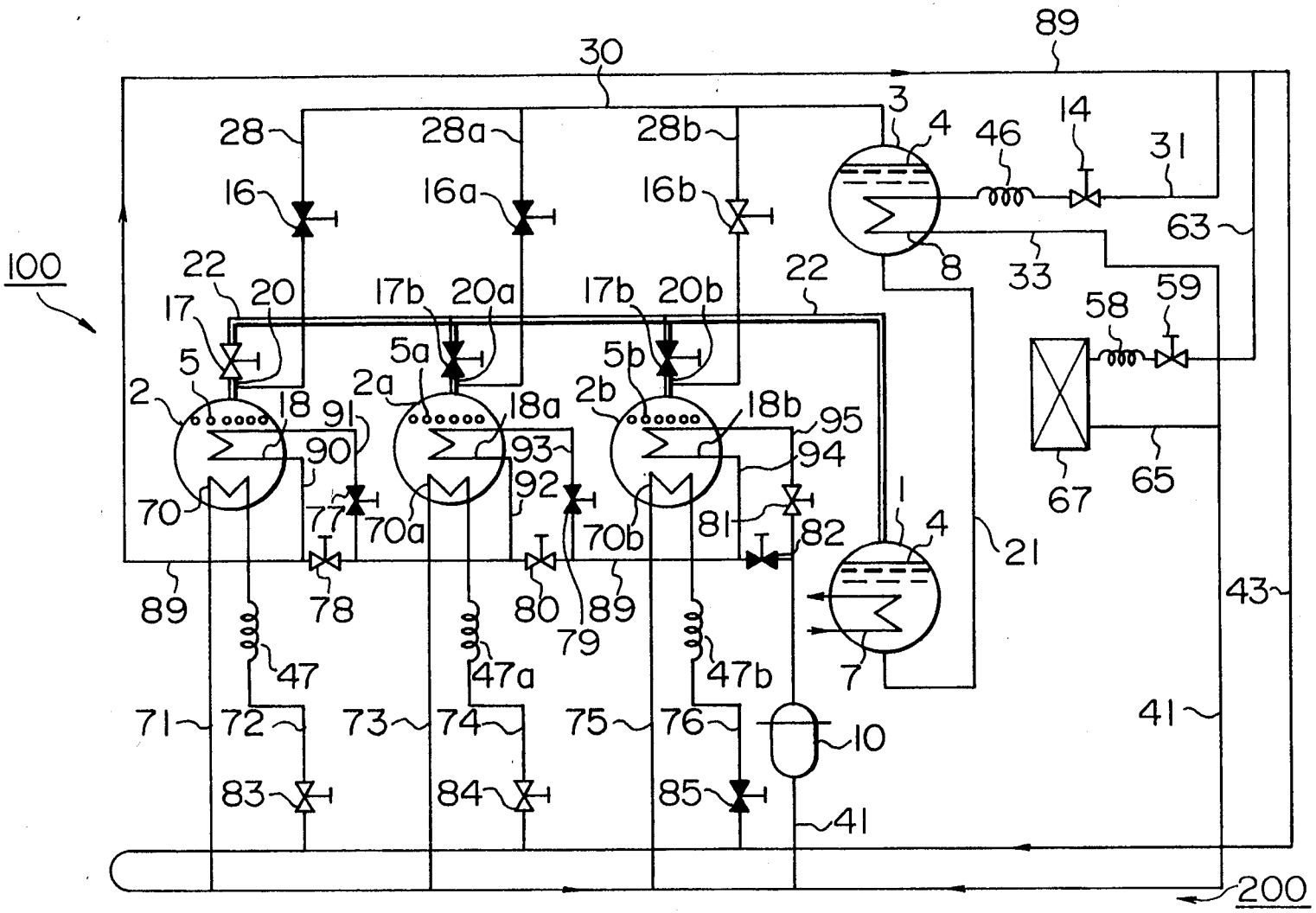
FIG. 6 is a block diagram of a modified embodiment of FIG. 5.

FIG. 6 is a block diagram of a modified example of the embodiment shown in FIG. 5. In this embodiment, heat exchangers 8, 67, 70, 70*a*, 70*b* are connected between pipes 43, 41 in parallel, respectively and pressure reduction mechanisms 46, 58, 47, 47*a*, 47*b* are provided with the pipes 31, 63, 72, 74, 76 connected to the respective heat exchangers so that the respective heat exchangers have a easily adjustable cooling ratio.

Figure 7:
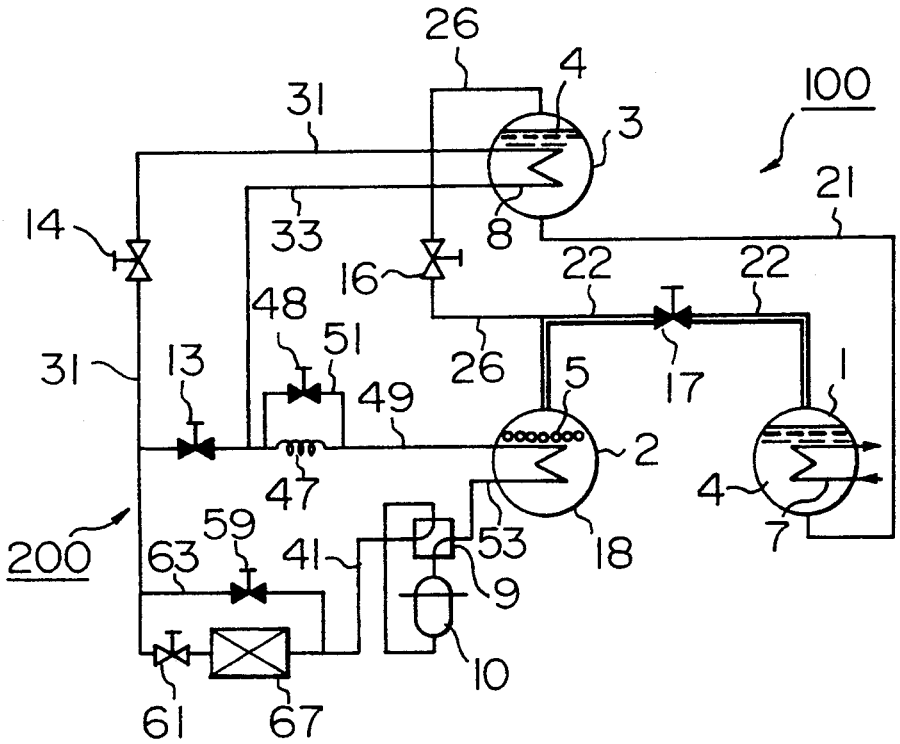
FIG. 7 is a block diagram of a further embodiment of the refrigerating apparatus of the present invention.
Figure 8:
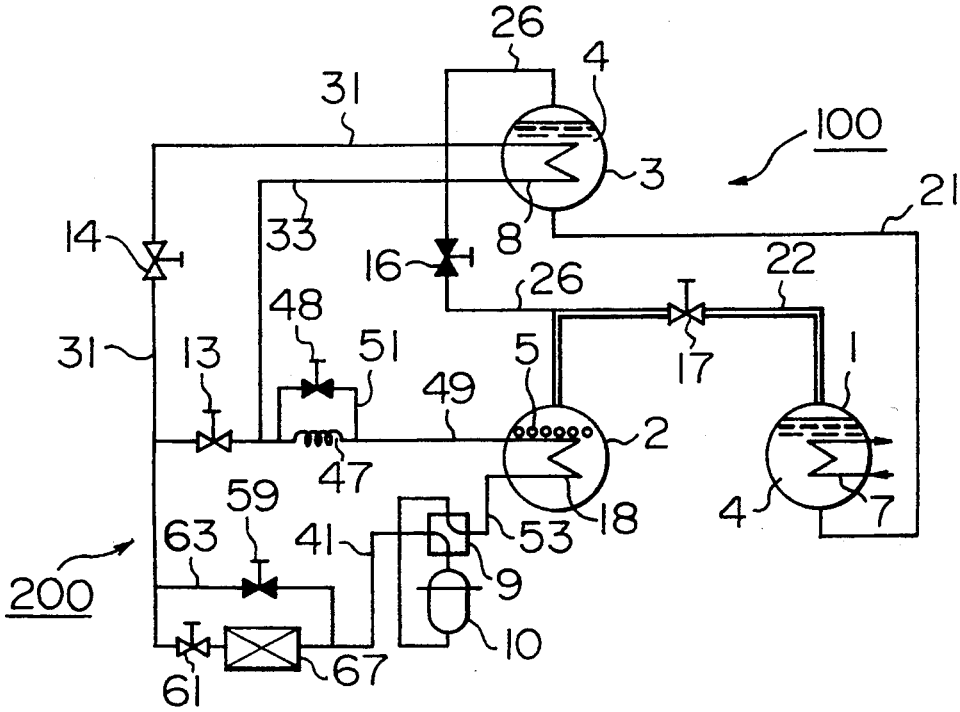
FIG. 8 is a block diagram showing a state in which the operating state of the refrigerating apparatus shown in FIG. 7 is changed.

A still further embodiment of the present invention will be described with reference to FIGS. 7, 8.

In this embodiment, a chemical type refrigerating unit 100 include only a set of a reactor 2. In FIG. 7, a valve 17 is closed and a valve 16 is opened so that a refresh operation is carried out between the reactor 2 and a condenser 3. For this purpose, the valves 13, 48, 59 of a compression type heat pump 200 are closed and the valves 14, 61 thereof are opened, and thus the temperature of the heat of the heat exchanger 8 in the reactor 3 and the temperature of the heat which the heat exchanger 67 obtains from the outside are increased by a compressor 10 and the heat is used to heat and refresh the reaction material 5 in the reactor 2. Further, when the valve 61 connected to the heat exchanger 67 is closed and the valve 59 connected thereto is opened, the temperature of only the heat of condensation produced in the condenser 3 can be increased by the compressor 10 and this heat can be effectively used. On the completion of the refresh operation, the valve 16 of the chemical type refrigerating unit is closed, the valve 14 of the compression type heat pump is closed and the valves 13, 48 are opened so that a thermal equilibrium is achieved between the heat exchangers 18 and 67. With this arrangement, the heat held by the reaction material 5 is discharged to the atmosphere through the heat exchanger 67. Thereafter, the valve 48 is closed and a 4-way valve 9 is switched and further the valve 17 of the chemical type refrigerating unit 100 is opened to start a refrigerating operation as shown in FIG. 8. More specifically, the reaction material 5 in the reactor 2 is sufficiently cooled by the evaporating action of the heat medium in the heat exchanger 18 and the heat of the heat medium is thrown away to the outside through the heat exchanger 67. Then, the liquid 4 in the evaporator 1 of the chemical type refrigerating unit 100 is effectively cooled and the cold heat thereof is taken out from the heat exchanger 7 and effectively used.

In the refrigerating apparatuses of the embodiments of the present invention described above, the chemical type refrigerating unit 100 has an efficiency of about 0.65 by itself. That is, 35% of energy is not recovered and discharged to the outside. On the other hand, the compression type heat pump 200 has a achievement coefficient (=discharged amount of heat/input to compressor) of about 4, assuming that a temperature on the evaporator side: 20° C., a temperature on the condenser side: 70° C., and (efficiency of machine)/(efficiency of motor) $\approx$0.6. Therefore, 25% of the amount of heat discharged from the compression type heat pump is the amount of heat resulting from the compressor.

According to these refrigerating apparatuses, although the above 35 of the energy is entirely recovered, when the energy input to the compressor is removed from it, 26% of the energy is substantially recovered. Therefore, these refrigerating apparatuses have an efficiency of 0.91.

What is claimed is:

1. A refrigerating apparatus, comprising:

a chemical type refrigerating unit including a first reactor having a reaction material accommodated therein, a second reactor having a reaction material accommodated therein, a condenser capable of communicating with said first reactor and said second reactor, first valve units for selectively communicating any one of said first reactor and said second reactor with said condenser, an evaporator for accommodating a liquid condensed by said condenser through a pipe and evaporating said liquid, and second valve units for selectively communicating any one of said first reactor and said second reactor with said evaporator; and a compression type heat pump including a compressor, a first heat exchanger provided with said first reactor, a second heat exchanger provided with said second reactor, a third heat exchanger and a fourth heat exchanger each provided with said condenser, a pressure reduction mechanism, and flow path switching units which are selectively switched to form a first circulating path for introducing a compressed medium output from said compressor to said second heat exchanger to heat the reaction material in said second reactor and introducing a pressure reduced medium having passed through said pressure reduction mechanism to said first heat exchanger to cool the reaction material in said first reactor and introducing said pressure reduced medium to said third heat exchanger to cool said condenser and a second circulating path for introducing a compressed medium output from said compressor to said first heat exchanger to heat the reaction material in said first reactor and introducing the pressure reduced medium having passed through said pressure reduction mechanism to said second heat exchanger to cool the reaction material in said second reactor and introducing said pressure reduced medium to said fourth heat exchanger to cool said condenser.

2. A refrigerating apparatus according to claim 1, wherein said first heat exchanger can be connected to said third heat exchanger in series and said second heat exchanger can be connected to said fourth heat exchanger in series.

3. A refrigerating apparatus according to claim 1, wherein said first heat exchanger can be connected to said third heat exchanger in parallel and said second heat exchanger can be connected to said fourth heat exchanger in parallel.

4. A refrigerating apparatus according to claim 1, wherein said flow path switching units are operated to alternatively switch said first circulating path and said second circulating path.

5. A refrigerating apparatus, comprising:

a chemical type refrigerating unit including not less than three sets of reactors each having a reaction material accommodated therein, a condenser capable of communicating with each of said reactors, an evaporator for accommodating a liquid condensed by said condenser through a pipe and evaporating said liquid, and valve units for communicating any of said reactors with said condenser and communicating the other of said reactors with said evaporator; and a compression type heat pump including a compressor, heating heat exchangers and cooling heat exchangers provided with said respective reactors, a cooling heat exchanger provided with said condenser, a pressure reduction mechanism, and switching units for forming a medium circulation path so that any of said heating heat exchangers provided with any of said reactors heats the reaction material in said reactor and the cooling heat exchangers of the remaining ones of said reactors cool the reaction materials in the remaining ones of said reactors as well as said cooling heat exchanger provided with said condenser cools said condenser.

6. A refrigerating apparatus according to claim 5, wherein said switching units are switched so that the refreshing operation, cooling operation and reaction operation of the reaction materials in said respective reactors can be circulated..

7. A refrigerating apparatus according to claim 5, a wherein a heat exchanger is connected to the medium circulation path of said compression type heat pump to obtain heat from the outside.

8. A refrigerating apparatus, comprising:

a chemical type refrigerating unit including a reactor having a reaction material accommodated therein, a condenser capable of communicating with said reactor, a first valve unit for selectively communicating said reactor with said condenser, an evaporator for accommodating a liquid condensed by said condenser through a pipe and evaporating said liquid, and a second valve unit for selectively communicating said evaporator with said reactor; and compression type heat pump including a compressor, a heat exchanger provided with said reactor, a heat exchanger provided with said condenser, a pressure reduction mechanism, and flow path switching units which are selectively switched to form a first circulation path for introducing a compressed medium output from said compressor to the heat exchanger provided with said reactor and introducing a pressure reduced medium having passed through said pressure reduction mechanism to the heat exchanger provided with said condenser and a second circulation path for introducing the pressure reduced medium having passed through said pressure reduction mechanism to the heat exchanger provided with said reactor and returning the medium having passed through said heat exchanger to said compressor.

9. A refrigerating apparatus according to claim 8, wherein a heat exchanger is connected to the circulation path of said heat pump to obtain heat from the outside.

10. A refrigerating apparatus according to claim 2, wherein heat exchangers are connected to the circulation path of said heat pump to obtain heat from the outside.

11. A refrigerating apparatus according to claim 3, wherein heat exchangers are connected to the circulation path of said heat pump to obtain heat from the outside.

* * * * *